US011476040B2

(12) United States Patent
Yan et al.

(10) Patent No.: US 11,476,040 B2
(45) Date of Patent: Oct. 18, 2022

(54) ULTRA-NARROW HIGH CURRENT POWER INDUCTOR FOR CIRCUIT BOARD APPLICATIONS

(71) Applicant: EATON INTELLIGENT POWER LIMITED, Dublin (IE)

(72) Inventors: Yipeng Yan, Pleasanton, CA (US); Yazhou Wang, Gaoyou (CN); Dengyan Zhou, Shanghai (CN)

(73) Assignee: Eaton Intelligent Power Limited, Dublin (IE)

( * ) Notice: Subject to any disclaimer, the term of this patent is extended or adjusted under 35 U.S.C. 154(b) by 437 days.

(21) Appl. No.: 16/665,173

(22) Filed: Oct. 28, 2019

(65) Prior Publication Data

US 2021/0125775 A1 Apr. 29, 2021

(51) Int. Cl.
*H01F 41/02* (2006.01)
*H01F 27/29* (2006.01)
*H01F 27/26* (2006.01)

(52) U.S. Cl.
CPC ..... *H01F 27/292* (2013.01); *H01F 27/263* (2013.01); *Y10T 29/49069* (2015.01)

(58) Field of Classification Search
CPC ..... H01F 27/292; H01F 17/04; H01F 27/24; H01F 17/043; H01F 27/2828; H01F 41/06; H01L 28/10; H01L 23/645; Y10T 29/49069; Y10T 29/49073; Y10T 29/4902; Y10T 29/49071; Y10T 29/49147; H05K 2201/1003; H05K 1/181; H05K 1/0233
USPC ..... 29/604, 602.1, 605, 606, 607, 842, 729, 29/740
See application file for complete search history.

(56) References Cited

U.S. PATENT DOCUMENTS 8,310,332 B2 11/2012 Yan et al.
9,202,617 B2 * 12/2015 Zhou ..... H01F 27/2847
9,842,682 B2 12/2017 Yan et al.
10,049,809 B2 * 8/2018 Kitamura ..... H01F 27/292

* cited by examiner

*Primary Examiner* — Thiem D Phan
(74) *Attorney, Agent, or Firm* — Baker Botts L.L.P.

(57) ABSTRACT

An electromagnetic component such as a power inductor includes first and second magnetic core pieces and a preformed coil winding therebetween. The preformed coil winding includes a top winding section and a pair of coplanar winding legs defining a U-shaped winding section therewith. The pair of winding legs are oriented perpendicular to a circuit board in use. First and second surface mount terminals respectively extend perpendicular to the pair of winding legs in opposing directions to each other, such that each of them extends only on one of the first and second magnetic core pieces but not the other.

20 Claims, 14 Drawing Sheets

STATE OF THE ART

STATE OF THE ART

ULTRA-NARROW HIGH CURRENT POWER INDUCTOR FOR CIRCUIT BOARD APPLICATIONS

BACKGROUND OF THE INVENTION

The field of the invention relates generally to electromagnetic inductor components, and more particularly to an ultra-narrow, surface mount power inductor component for high power, high current circuit board applications.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit by inducing current flow through the windings. Power inductors may, for example, provide regulated power from rapidly switching power supplies in an electronic device. Power inductors may also be utilized in electronic power converter circuitry.

Existing power inductors are problematic in some aspects and improvements are desired. Specifically, trends to produce increasingly powerful, yet smaller electronic devices have led to numerous challenges to the electronics industry concerning circuit board components such as power inductors that must likewise handle the same or increased amount of power in a smaller package size. Increasingly miniaturized circuit board components are therefore desired to reduce the area occupied on a circuit board by the component (sometimes referred to as the component "footprint") and/or the component height measured in a direction perpendicular to the plane of the circuit board (sometimes referred to as the component "profile"). By decreasing the footprint and/or profile, the size of the circuit board assemblies for electronic devices can be reduced and/or the component density on the circuit board(s) can be increased. While much success has been realized in recent years regarding miniaturization of circuit board components, challenges remain and in aspects market needs have not completely been met with current component designs and manufactures.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
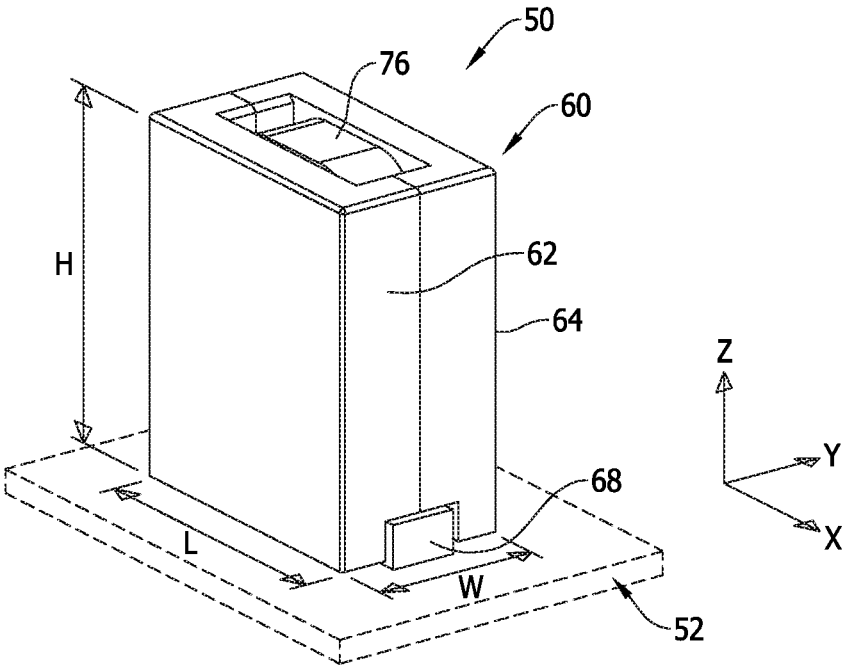
FIG. 1 is a perspective view of a state of the art high current power inductor including surface mount terminations for a circuit board application.
Figure 2:
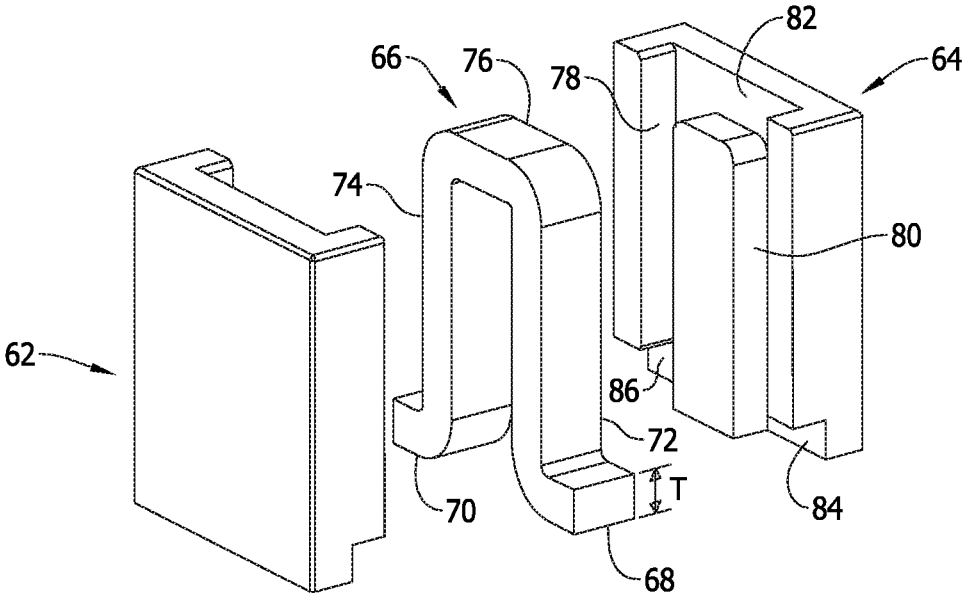
FIG. 2 is an exploded view of the power inductor shown in FIG. 1.

FIGS. 1 and 2 illustrate a perspective view and an exploded view of a state of the art high current electromagnetic component 50 that is surface mounted to a circuit board 52 using, for example, a known soldering technique. The circuit board 52 and electromagnetic component 50 define a portion of electronic circuitry included in an electronic device.

The electromagnetic component 50 generally includes a magnetic core 60 defined by a first magnetic core piece 62 and a second magnetic core piece 64. A conductive coil winding 66 is contained in respective portions of each of the first and second magnetic core pieces 62, 64. In combination, the magnetic core pieces 62, 64 impart an overall length L of the magnetic core 60 along a first dimension such as an x axis of a Cartesian coordinate system. Each magnetic core piece 62, 64 also has a width W measured along a second dimension perpendicular to the first axis such as a y axis of a Cartesian coordinate system, and a height H measured along a third dimension perpendicular to the first and second axis such as a z axis of a Cartesian coordinate system.

As seen in FIG. 1, the component dimensions L and H are much greater than the dimension W, such that when the component 50 is mounted to the circuit board 52 in the x, y plane the component 50 has a relatively large height dimension H along the z axis, while the relatively small width dimension still allows for a reduction of the footprint of the component 50 when mounted to the circuit board 52. The increased height dimension facilitates a relatively long coil winding 66 while nonetheless requiring a relatively small footprint, allowing the component 50 to capably handle higher current, higher power applications beyond the limits of other electromagnetic component constructions wherein the height dimension is reduced in the component design to lower the profile of the component when mounted to the circuit board.

The coil winding 66 is a preformed conductive element fabricated from a planar strip of conductor material that is bent into the shape as shown including surface mount terminals 68, 70 extending coplanar to one another on the bottom of the component 50 that abuts the circuit board in use, winding legs 72 and 74 extending perpendicular from each of the surface mount terminals 68, 70, and a top winding section 76 that interconnects the ends of the winding legs 72, 74. The winding legs 72, 74 and the top winding section 76 are generally U-shaped, with the winding legs 72, 74 being bent substantially perpendicular to the plane of the top winding section 76. The surface mount terminals 68, 70 extend perpendicular to the plane of the winding legs 72, 74 and extend in opposite directions to one another along the length dimension L. The thickness dimension t of the coil winding is relatively large to more capably handle higher current in use.

Each of the magnetic core pieces 62, 64 are generally identically formed to include vertically extending slots 78, 80 an upper recess 82 and lower recesses 84 and 86. The magnetic core pieces 62, 64 are arranged as mirror images of one another about the coil winding 66 with each winding leg 72, 74 extending partly in the vertical slots 78, 80 in each magnetic core piece 62, 64. The top winding section 76 extends partly in each of the upper recesses 82 in each magnetic core piece 62, 64, and the surface mount terminals 68, 70 extend partly in each of the lower recesses 84, 86. As a result, the width dimension W of the component 50 is relatively small. Each magnetic core piece 62, 64 receives only a portion of the corresponding width W of the coil winding 66 in the width dimension and the magnetic core pieces 62, 64 may also be relatively small in the width dimension.

Advantageously, the component 50 is scalable in a modular manner to include additional magnetic core pieces and additional coil windings to easily adapt the component for multi-phase power applications or to obtain further space efficiencies by incorporating multiple coil windings on a common core structure that occupies less space on the circuit board than a plurality of discrete components 50 including a single coil winding 66 would occupy if separately provided. The reader is referred to U.S. Pat. No. 9,842,682 for further details regarding modular assemblies of inductor components having coil windings 66 and their benefits.

From the perspective of further width reduction in the component 50, the coil winding 66 has been found to be problematic from a manufacturing perspective. Specifically, to handle the same power as before, a reduced width of the coil winding 66 means that the thickness t of the winding needs to increase, but as the thickness increases the coil winding 66 becomes more difficult to bend. Particularly difficulties are realized in bending the coil winding 66 to the desired shape when the width dimension of the coil winding 66 becomes less than the thickness. Such difficulties raise the cost of manufacturing the component 50 including the coil winding 66, raise performance and reliability issues, and impose practical limits on the ability to reduce the width of the component (and reduce the footprint of the component in the width dimension on the circuit board to an optimal level that provides further space efficiency on the circuit board 52.

Exemplary embodiments of inventive electromagnetic component assemblies and constructions are described below for higher current and power applications having reduced footprints in the width dimension that are difficult, if not impossible, to achieve, using the coil windings 66 and conventional techniques. Electromagnetic components and devices such as power inductors components may also be fabricated with reduced cost compared to other known miniaturized power inductor constructions. Manufacturing methodology and steps associated with the devices described are in part apparent and in part specifically described below but are believed to be well within the purview of those in the art without further explanation.

Figure 3:
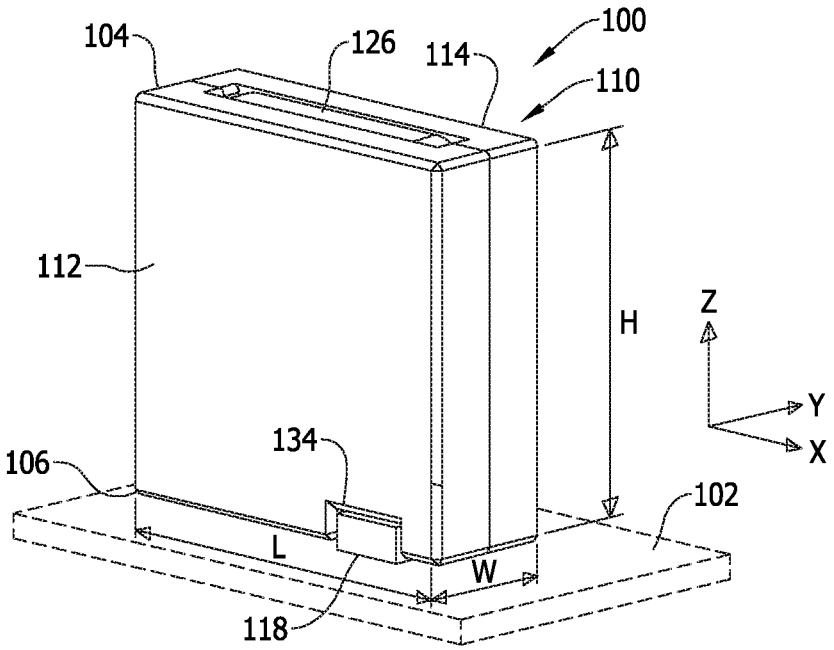
FIG. 3 is a perspective view of an improved high current power inductor including surface mount terminations for a circuit board application according to a first exemplary embodiment of the invention.
Figure 4:
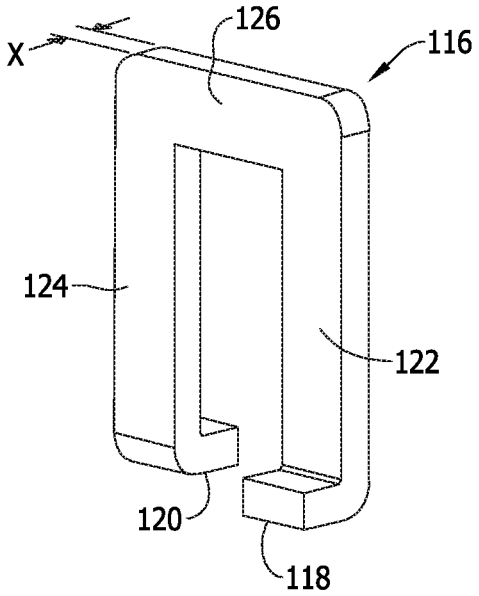
FIG. 4 is a perspective view of an inductor coil winding for the power inductor shown in FIG. 3.
Figure 5:
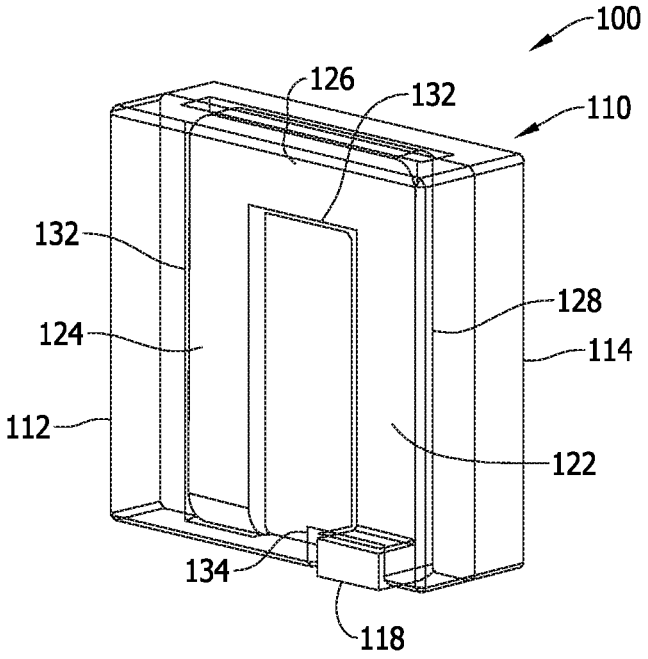
FIG. 5 is a partly transparent perspective view of the power inductor shown in FIG. 3.
Figure 6:
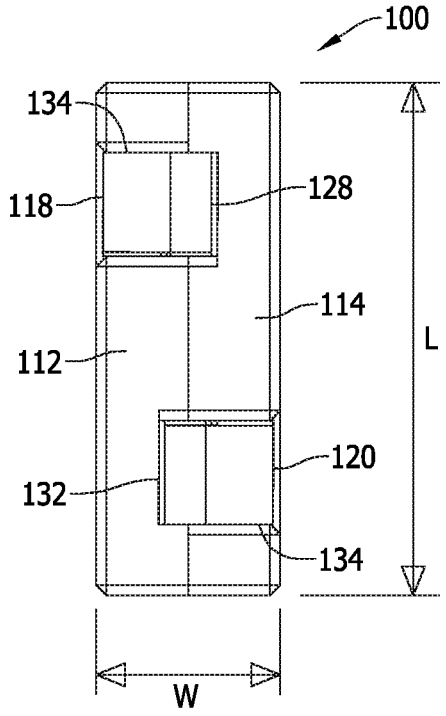
FIG. 6 is a bottom view of the power inductor shown in FIGS. 3 and 5 and illustrating the surface mount terminals of the inductor coil winding shown in FIG. 4.

FIGS. 3 through 6 illustrate various views of an improved electromagnetic component 100 according to a first exemplary embodiment of the invention, wherein FIG. 3 is a perspective view of the component 100, FIG. 4 is a perspective view of an inductor coil winding for the component 100, FIG. 5 is a partly transparent perspective view of the component 100, and FIG. 6 is a bottom view of the component 100. As described below, the component 100 is configured as a power inductor component, although other types of electromagnetic components may benefit from the teachings described below, including but not necessarily limited to inductor components other than power inductors.

The electromagnetic component 100 is surface mounted to a circuit board 102 using, for example, a known soldering technique. The circuit board 102 and electromagnetic component 100 define a portion of electronic circuitry included in an electronic device.

The electromagnetic component 100 generally includes a magnetic core 110 defined by a first magnetic core piece 112 and a second magnetic core piece 114. The core 110 and each of the first magnetic core piece 110 and the second magnetic core piece 112 generally include a top side 104 and a bottom side 106, wherein the top side 104 is elevated from the circuit board 102 and the bottom side 106 is proximate the circuit board 102 in use. The first magnetic core piece 110 and the second magnetic core piece 112 are arranged vertically relatively to the circuit board 102 in a side-by-side relationship to one another.

A conductive coil winding 116 is received in between and contained by respective portions of each of the first and second magnetic core pieces 112, 114. In combination, the magnetic core pieces 112, 114 impart an overall length L of the magnetic core 110 along a first dimension such as an x axis of a Cartesian coordinate system. Each magnetic core piece 112, 114 also has a width W measured along a second dimension perpendicular to the first axis such as a y axis of a Cartesian coordinate system, and a height H measured along a third dimension perpendicular to the first and second axis such as a z axis of a Cartesian coordinate system.

As seen in FIG. 3, the component dimensions L and H are much greater than the dimension W, such that when the component 100 is mounted to the circuit board 102 in the x, y plane the component 100 has a relatively large height dimension H along the z axis, and a reduced width dimension W still allows for a reduction of the footprint of the component 100 when mounted to the circuit board 102. The increased height dimension facilitates a relatively long coil winding 116 while nonetheless requiring a relatively small footprint, allowing the component 100 to capably handle higher current, higher power applications with a substantial reduction in width.

The coil winding 116 (FIG. 4) is a preformed conductive element fabricated from a planar sheet of conductive material that is formed and bent into the shape as shown including surface mount terminals 118, 120 extending coplanar to one another on the bottom of the component 100 that abuts the circuit board in use, winding legs 122 and 124 extending perpendicular from each of the surface mount terminals 118, 120, and a top winding section 126 that interconnects the ends of the winding legs 122, 124. The winding legs 122, 124 and the top winding section 126 are generally U-shaped, but unlike the coil 66 described above in the component 50, the winding legs 122, 124 and the top winding section 126 are all coplanar elements in the coil winding 116. The surface mount terminals 118, 120 extend perpendicular to the plane of the winding legs 122, 124 and the top winding section 126, with the surface mount terminals extending in opposite directions to one another along the width dimension W. More specifically, the first surface mount terminal 118 extends toward the first magnetic piece 112 and away from the second magnetic core piece 114, while the second surface mount terminal 120 extends toward the second magnetic piece 114 and away from the first magnetic core piece 112 as shown in FIG. 6. As such, the respective surface mount terminals 118, 120 generally reside on the bottom of only one of the two magnetic core pieces 112, 114 provided.

Like the coil winding 66, the coil winding 116 defines less than one complete turn of an inductor winding in the magnetic core, yet has a sufficient thickness t and cross sectional area to capably conduct higher current to meet performance requirements in higher power circuity implemented on the circuit board 102. Compared to the coil winding 66 that is formed from a planar, elongated strip of material that is subsequently shaped with four bends into the desired U-shape with surface mount terminals as shown and described in relation to FIG. 2, the coil winding 116 only includes two bends to fabricate into the desired U-shape with surface mount terminals and is therefore simpler to fabricate.

In contemplated embodiments of fabricating the coil winding 116, a coil winding pattern including the surface mount terminals 118, 120, the winding legs 122, 124 and the top winding section 126 may be stamped or otherwise cut from a sheet of a conductive material having the desired thickness at a first stage of manufacture. At a second stage of manufacture the surface mount terminals 118, 120 may each be bent from the plane of the winding legs 122, 124 and the top winding section 126 in opposite directions. As such, the coil winding 66 requires two additional bends to shape the top winding section while the coil winding 116 does not, thereby avoiding complications and difficulties in bending the relatively small top winding section that the coil 66 requires.

The thickness t of the conductive material used to fabricate the winding legs 122, 124 and the top winding section 126 that define the U-shaped coil winding section is oriented to extend parallel to and resides in the width dimension instead of extending parallel to and residing in the length and height dimension of the coil winding 66 in the component 50. In other words, the thickness of the material used to fabricate the coil winding 116 is rotated 90° from the orientation of the thickness of the material used to fabricate the coil winding 66. The plane of the coplanar winding legs 122, 124 in the component 100 extends parallel to the length dimension L in the component 100, whereas in the coil winding 66 the winding legs 72, 74 extend parallel to the width dimension. Since in each case, the thickness dimension t of the conductive material used to fabricate the coil winding is considerably less than its width when the conductor is shaped to final form, substantial reduction of the width of the component 100 relative to the component 50 is therefore possible while otherwise having similar power capabilities for high current, high power circuitry established on the circuit board 102.

In contemplated embodiments, the magnetic core pieces 112, 112 may be fabricated into discrete, shaped magnetic core pieces as shown and described utilizing soft magnetic particle materials and known techniques such as molding of granular magnetic particles to produce the desired shapes. Soft magnetic powder particles used to fabricate the magnetic core pieces may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. In some cases, magnetic powder particles may be are coated with an insulating material such the magnetic core pieces may possess so-called distributed gap properties familiar to those in the art and fabricated in a known manner. The magnetic core pieces may be fabricated from the same or different magnetic materials and as such may have the same or different magnetic properties as desired. The magnetic powder particles used to fabricate the magnetic core pieces may be obtained using known methods and techniques and molded into the desired shapes also using known techniques.

In the exemplary embodiment illustrated, of the magnetic core pieces 112, 114 are generally identically formed as discrete, shaped core elements which include vertically extending slots 128, 130 one side thereof, a centrally located upper recess 132 and a single off-centered lower recess 134 on a bottom edge thereof. The magnetic core pieces 112, 114 are arranged as mirror images of one another about the coil winding 116 with each winding leg 122, 124 extending partly in the vertical slots 128, 130 in each magnetic core piece 112, 114. Because the thickness dimension t of the coil winding 116 is oriented along the length dimension of the component 100, the vertically extending slots 128, 130 can be relatively shallow in comparison to the magnetic core pieces 62, 64 in the component 50, thereby allowing for some simplification in the shape of the magnetic core pieces and therefore providing further manufacturing benefits. The magnetic core pieces 112, 114 and the coil windings 116 may be separately fabricated in batch processing, and provided as preformed and prefabricated modular elements for assembly into components 100 in a reduced amount of time and at lower cost with respect to certain conventional component constructions wherein coil windings are formed and fabricated upon substrate materials in thin layers in a sequenced manner.

When assembled, the top winding section 126 extends partly in each of the upper recesses 132 in each magnetic core piece 112, 114 at a distance elevated from the circuit board 102 and generally parallel to the plane of the circuit board 102, the winding legs 122 and 124 extend vertically from the horizontal plane of the circuit board (i.e., perpendicular to the plane of the circuit board 102 and to the top winding section 126) for a desired distance in the height dimension H, and the surface mount terminals 118, 120 extend respectively in the lower recess 134 of one of the magnetic core pieces 112, 114. The top winding section 126 is exposed on the upper or top side of the magnetic core pieces 112, 114 that is elevated from the circuit board 102, while the surface mount terminals 118, 120 are exposed on the lower or bottom side of the magnetic core pieces 112, 114 for surface mounting to the circuit board 102 using known techniques. The width dimension W of the assembled component 100 is about equal to the overall distance between the distal ends of the surface mount terminals 118, 120 in the width dimension. The combination of the thickness t of the coil winding 116 residing in the width dimension and the oppositely directed surface mount terminals 118, 120 in the width dimension allows the width dimension W of the assembled component 100 to be substantially minimized. The component 100 is accordingly sometimes referred to as an ultra-narrow component relative to the component 50 and other electromagnetic components having similar performance capabilities but a greater width dimension.

The component 100 is scalable in a modular manner as further described below to include additional magnetic core pieces and additional coil windings and easily adapt the component for multi-phase power applications or to obtain further space efficiencies by incorporating multiple coil windings on a common core structure that occupies less space on the circuit board than a plurality of discrete components 50 including a single coil winding 66.

Figure 7:
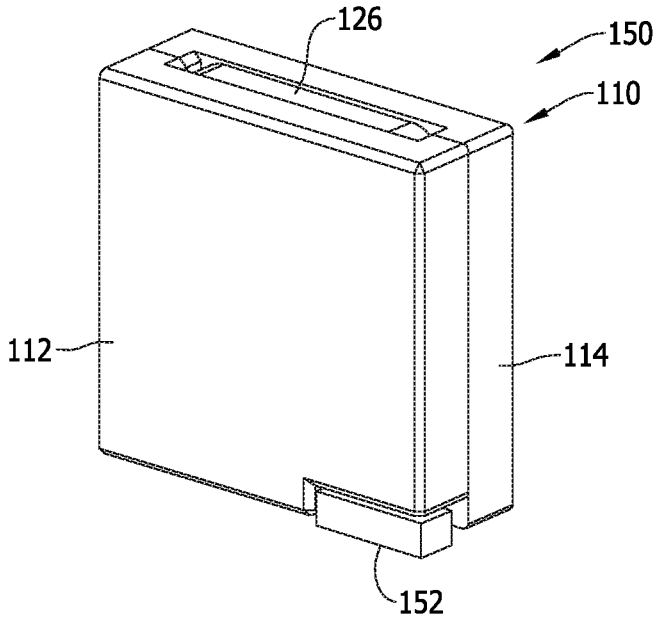
FIG. 7 is a perspective view of an improved high current power inductor including surface mount terminations for a circuit board application according to a second exemplary embodiment of the invention.
Figure 8:
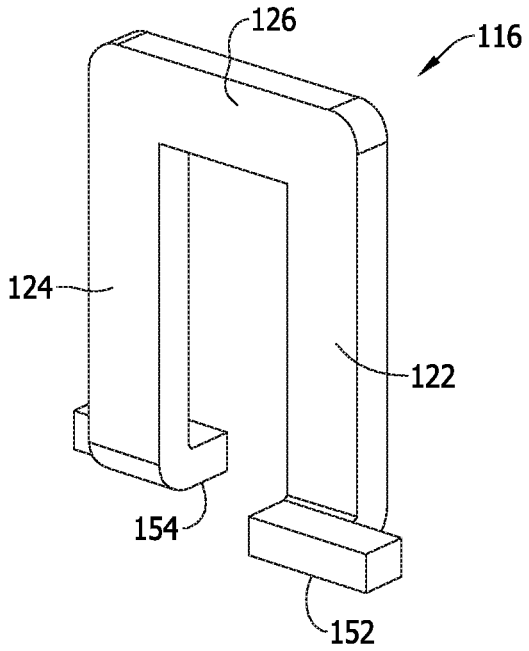
FIG. 8 is a perspective view of an inductor coil winding for the power inductor shown in FIG. 7.
Figure 9:
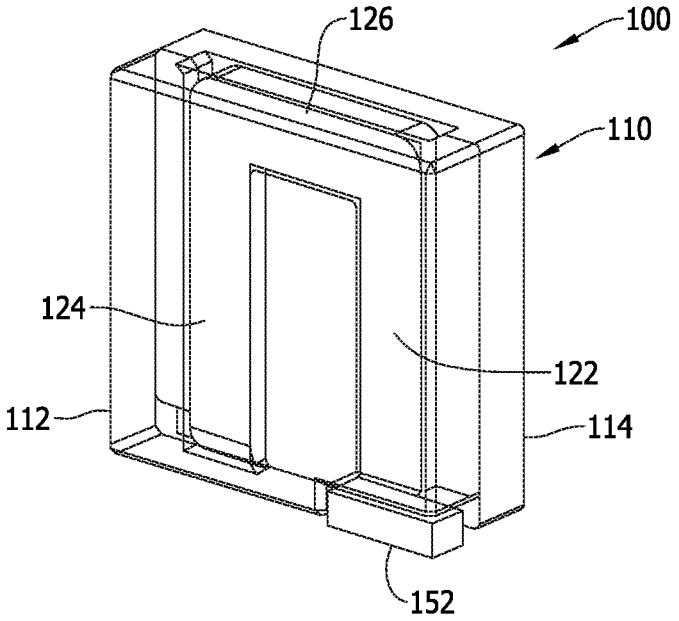
FIG. 9 is a partly transparent perspective view of the power inductor shown in FIG. 7.
Figure 10:
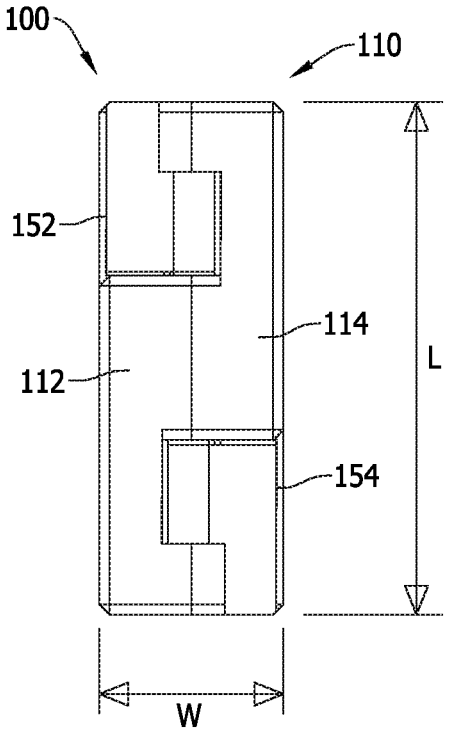
FIG. 10 is a bottom view of the power inductor shown in FIGS. 3 and 5 and illustrating the surface mount terminals of the inductor coil winding shown in FIG. 4.

FIGS. 7-10 illustrate various views of an improved electromagnetic component 150 according to a second exemplary embodiment of the invention, wherein FIG. 7 is a perspective view of the component 150, FIG. 8 is a perspective view of an inductor coil winding for the component 150, FIG. 9 is a partly transparent perspective view of the component 150, and FIG. 10 is a bottom view of component 150. The component 150 may be configured as a power inductor component in contemplated embodiments. The component 150 may be used in lieu of or in addition to the component 100 on the circuit board 102.

The component 150 is seen to be similar to the component 100 but includes surface mount terminals 152, 154 in the coil winding 116 which are enlarged to provide an increased surface area to make connections to the circuit board. In the example shown, the enlarged surface mount terminals 152, 154 are elongated in the length dimension in the assembled component 150. As such, and unlike the surface mount terminals 118, 120 in the component 100, the outer distal ends of the surface mount terminals 152, 154 extend beyond the respective peripheral side edges of the coplanar winding legs 122, 124, providing further elongation in the surface mount terminals 152, 154 on the sides and bottom of the component 150 adjacent the circuit board in use. In other words, in the length dimension L of the assembled component 150, the dimensions of the surface mount terminals exceed the corresponding dimension of the winding legs.

In FIG. 10 the enlarged surface mount terminals 152, 154 in the component 150 extend to the lateral and longitudinal side edges of the magnetic core pieces 112, 114 on the bottom of the magnetic core, while the surface mount terminals 118, 120 in the component 100 are spaced from the lateral edges of the magnetic core pieces 112, 114 as shown in FIG. 6. The increased contact surface area afforded by the enlarged surface mount terminals 152, 154 lowers contact resistance and improves the efficiency of the component 150 in use. Except for the enhancements in the surface mount terminals 152, 154, the benefits of the components 100 and 150 are otherwise similar.

Figure 11:
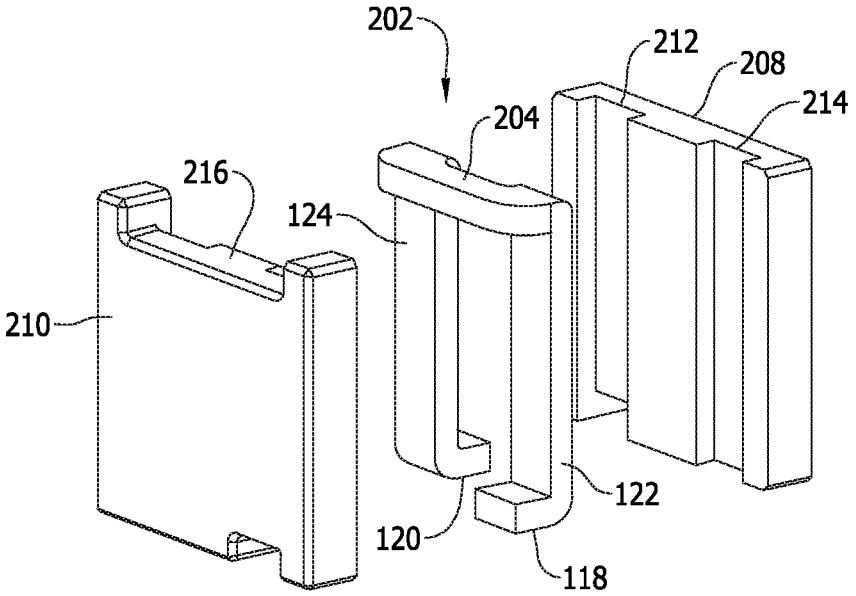
FIG. 11 is an exploded view of an improved high current power inductor including surface mount terminations for a circuit board application according to a third exemplary embodiment of the invention.
Figure 12:
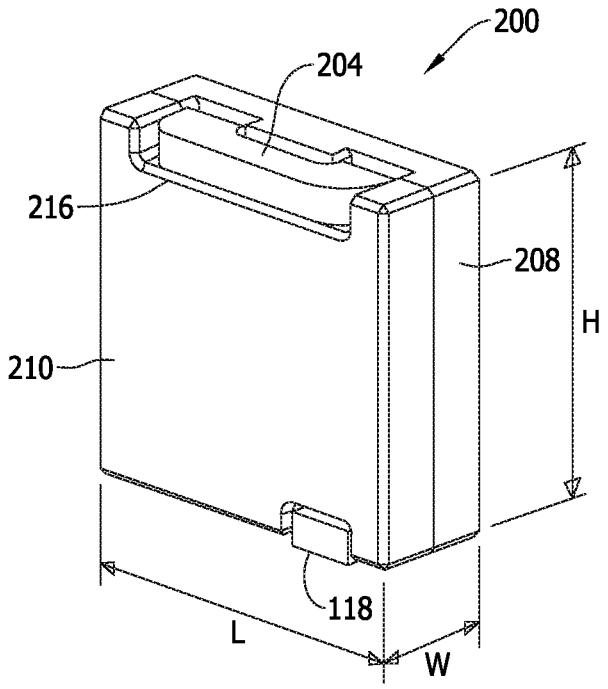
FIG. 12 is a perspective assembly view of the power inductor shown in FIG. 11.

FIGS. 11 and 12 illustrate various views of an improved electromagnetic component 200 according to a third exemplary embodiment of the invention, wherein FIG. 11 is an exploded view of the component 200 and FIG. 12 is a perspective assembly view of the component 200. The component 200 may be configured as a power inductor component in contemplated embodiments. The component 200 may be used in lieu of or in addition to the component 100 or 150 on the circuit board 102.

The component 200 includes a coil winding 202 having the surface mount terminals 118, 120 extending perpendicularly to coplanar winding legs 122, 124 as described above, but with the top winding section 204 bent to extend perpendicular to the plane of the winding legs 122, 124. The coil winding 202 accordingly requires three bends to form the coil (one to shape each surface mount terminal and one to bend the top section of the U-shaped section out of plane to realize the top winding section 204) instead of two bends in the coil winding 116, but with the advantage that the bent top winding section 204 reduces the height H of the component 200 and lowers the component profile while providing similar performance capability than the component 100. The bent top winding section 204 also provides an ability to adjust the direct current resistance in the coil when desired.

Unlike embodiments above wherein the magnetic core pieces are substantially identically fabricated to have the same shape, the component 200 includes magnetic core pieces 208 and 210 that are differently shaped from one another. Each magnetic core piece 208 and 210 includes vertically extending slots to receive the winding legs 122, 124 but the magnetic core piece 210 includes an upper recess that receives the bent top winding section 204. The bent top winding section 204 overlies only of the magnetic core pieces in this embodiment and is off-centered on the top of the component whereas in the previous embodiments the top winding section 126 is generally centered in the top of the component. The magnetic core piece 210 is also slightly smaller than the magnetic core piece 208, leading to some material savings in the fabrication of the magnetic core pieces relative to the previously described embodiments. The component 200 otherwise has the minimal width W and the advantages thereof described previously.

Figure 13:
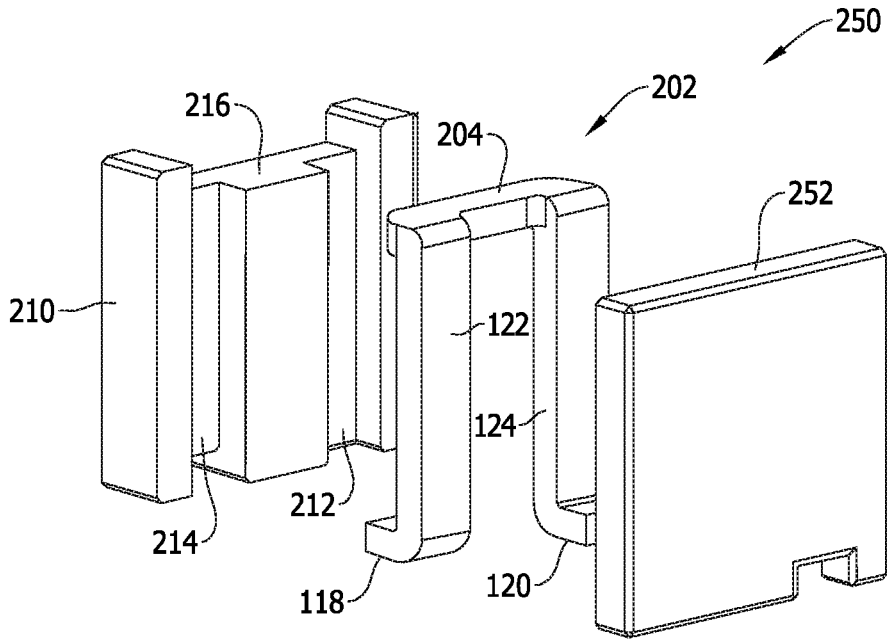
FIG. 13 is an exploded view of an improved high current power inductor including surface mount terminations for a circuit board application according to a fourth exemplary embodiment of the invention.

FIG. 13 is an exploded view of an improved electromagnetic component 250 according to a fourth exemplary embodiment of the invention. The component 250 may be configured as a power inductor component in contemplated embodiments. The component 250 may be used in lieu of or in addition to the component 100, 150 or 200 on the circuit board 102.

The component 250 includes the coil winding 202 and the first magnetic core piece 210 having vertical slots 212, 214 that respectively receive the coplanar winding legs 122, 124 of the coil winding 202. A second magnetic core piece 252 is provided that does not include vertical slots and does not include an upper recess. The second magnetic core piece 252 therefore has a simpler shape that is easier to fabricate. The assembly of the component 250 is also comparatively simpler than the preceding embodiments wherein both magnetic core pieces include vertical slots. The component 250 otherwise has the minimal width W and the advantages thereof described previously.

Figure 14:
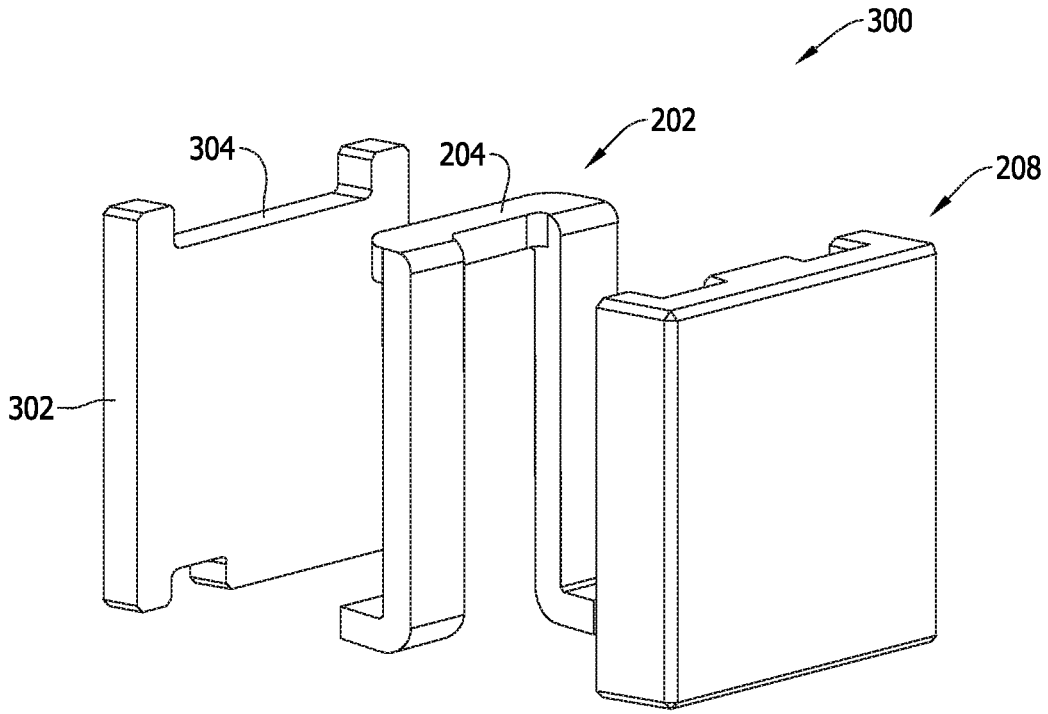
FIG. 14 is an exploded view of an improved high current power inductor including surface mount terminations for a circuit board application according to a fifth exemplary embodiment of the invention.

FIG. 14 is an exploded view of an improved electromagnetic component 300 according to a fifth exemplary embodiment of the invention. The component 300 may be configured as a power inductor component in contemplated embodiments. The component 300 may be used in lieu of or in addition to the component 100, 150, 200 or 250 on the circuit board 102.

The component 300 includes the coil winding 202 and the magnetic core piece 208 that includes vertical slots 212, 214 but not an upper recess as described in the component 200 and shown in FIG. 8. The component 300 further includes a second magnetic core piece 302 that does not include vertical slots but does include an upper recess 304 to receive the bent top winding section 204 of the coil winding 202 when the component is assembled. Some simplification in the shape of the magnetic core pieces is therefore provided in the component 300 relative to some of the previous embodiments, while also featuring the minimal width W and the advantages thereof described previously.

Figure 15:
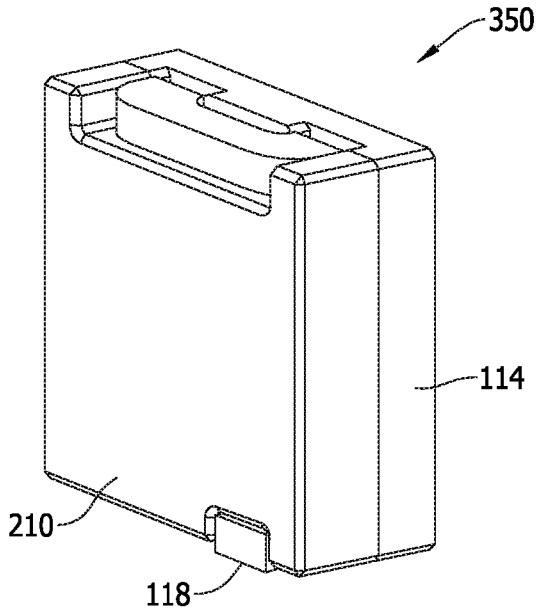
FIG. 15 is a perspective view of an improved high current power inductor including surface mount terminations for a circuit board application according to a sixth exemplary embodiment of the invention.
Figure 16:
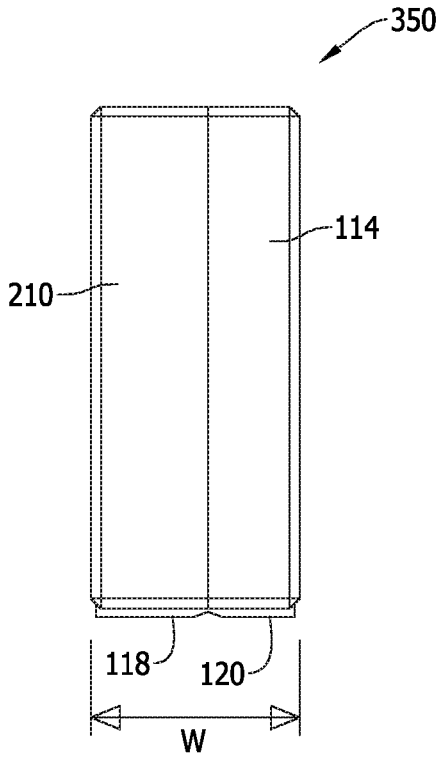
FIG. 16 is a first side elevational view of the power inductor shown in FIG. 15.
Figure 17:
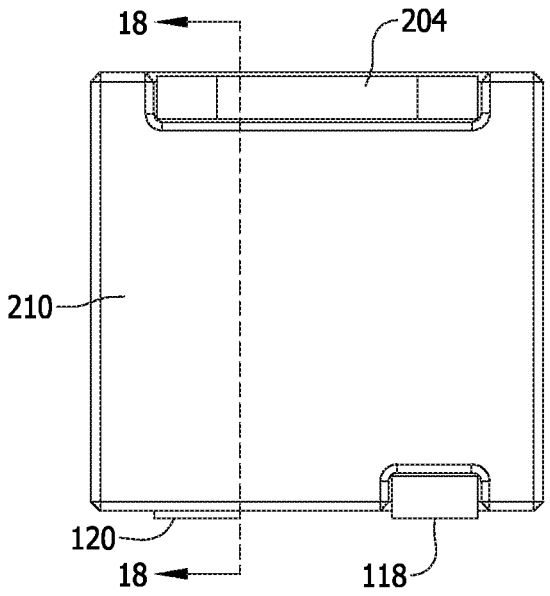
FIG. 17 is a second side elevational view of the power inductor shown in FIG. 15.
Figure 18:
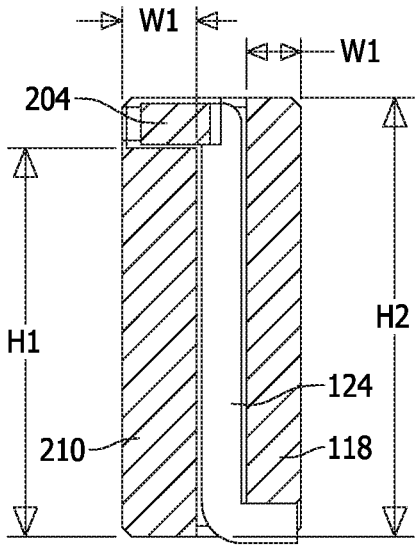
FIG. 18 is a sectional view of the power inductor shown in FIG. 17 taken along line 18-18.

FIGS. 15-18 illustrate various views of an improved electromagnetic component 350 according to a sixth exemplary embodiment of the invention, wherein FIG. 15 is a perspective view the component 350, FIG. 16 is a first side elevational view of component 350, FIG. 17 is a second side elevational view of the component 350, and FIG. 18 is a cross-sectional view of the component 350. The component 350 may be configured as a power inductor component in contemplated embodiments. The component 350 may be used in lieu of or in addition to the component 100, 150, 200, 250 or 300 on the circuit board 102.

The component 350 includes the magnetic core pieces 210 and 114 that each include vertical slots for the coplanar winding legs, and the coil winding 202 including the bent top winding section 204. In order to balance the magnetic path to help optimize and maximize the performance of the inductor, an asymmetrical path is created in the magnetic core by varying the width (excluding the vertical slots) of the magnetic core pieces 210, 114 as best shown in cross section in FIG. 18. In FIG. 18, the magnetic core piece 114 has a smaller width W2 than the width W1 of the magnetic core piece 210 that receives the bent top winding section 204. As seen in FIG. 16, the surface mount terminal 118 is wider than the surface mount terminal 120 due to the different widths of the magnetic core pieces 210, 114. The overall width W (FIG. 16) is still practically minimized, while the effects of an unbalanced magnetic path attributable to the bent top winding section 204 are reduced. A minimal width W having the desired performance characteristics is still realized in the component 350, and the advantages thereof described previously are still accrued.

Figure 19:
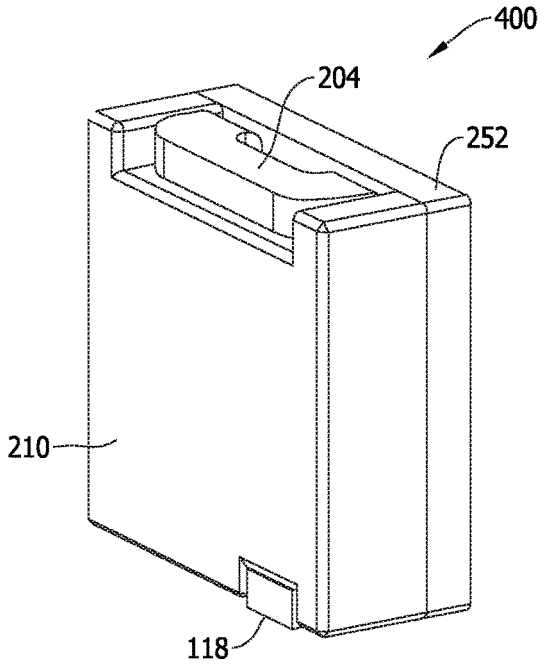
FIG. 19 is a perspective view of an improved high current power inductor including surface mount terminations for a circuit board application according to a seventh exemplary embodiment of the invention.

FIG. 19 is a perspective view of an improved electromagnetic component 400 according to a seventh exemplary embodiment of the invention. The component 400 is similar to the component 250 but includes adjustment of the widths of the magnetic core pieces 210, 252 to realize an asymmetrical path in the magnetic core and obtain the benefits described above. The component 400 may be configured as a power inductor component in contemplated embodiments, and has similar advantages to the embodiments described above.

Figure 20:
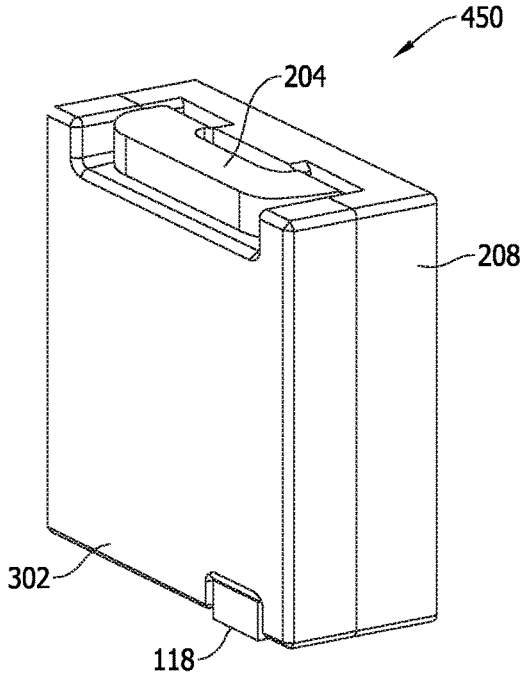
FIG. 20 is a perspective view of an improved high current power inductor including surface mount terminations for a circuit board application according to an eighth exemplary embodiment of the invention.

FIG. 20 is a perspective view of an improved electromagnetic component 450 according to an eighth exemplary embodiment of the invention. The component 450 is similar to the component 300 but includes adjustment of the widths of the magnetic core pieces 302, 208 to realize an asymmetrical path in the magnetic core and obtain the benefits described above. The component 450 may be configured as a power inductor component in contemplated embodiments, and has similar advantages to the embodiments described above.

Figure 21:
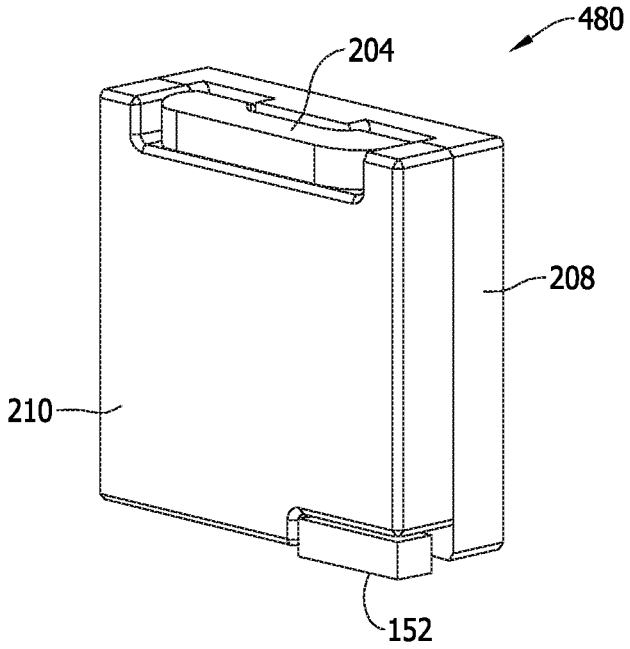
FIG. 21 is a perspective view of an improved high current power inductor including surface mount terminations for a circuit board application according to a ninth exemplary embodiment of the invention.
Figure 22:
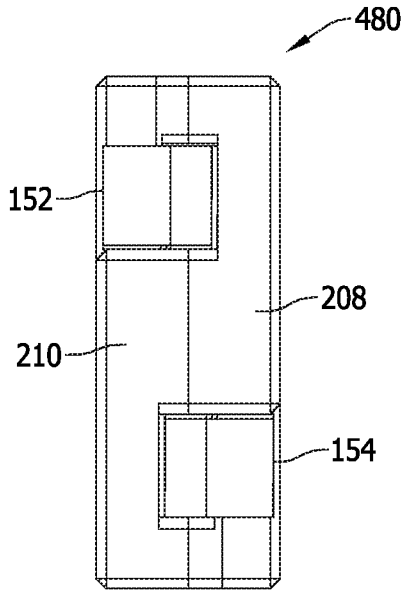
FIG. 22 is a bottom view of the power inductor shown in FIG. 21 and illustrating the surface mount terminals of the inductor coil winding.

FIGS. 21 and 22 illustrate views of an improved electromagnetic component 480 according to a ninth exemplary embodiment of the invention. FIG. 21 is a perspective view of the component 480, and FIG. 22 is a bottom view of the component 480. The component 480 is similar to the component 200 described above but includes the enlarged surface mount terminals 152, 154 in the coil winding 202. The component 482 may be configured as a power inductor component in contemplated embodiments. The component 480 may be used in lieu of or in addition to the previously described components on the circuit board 102.

Figure 23:
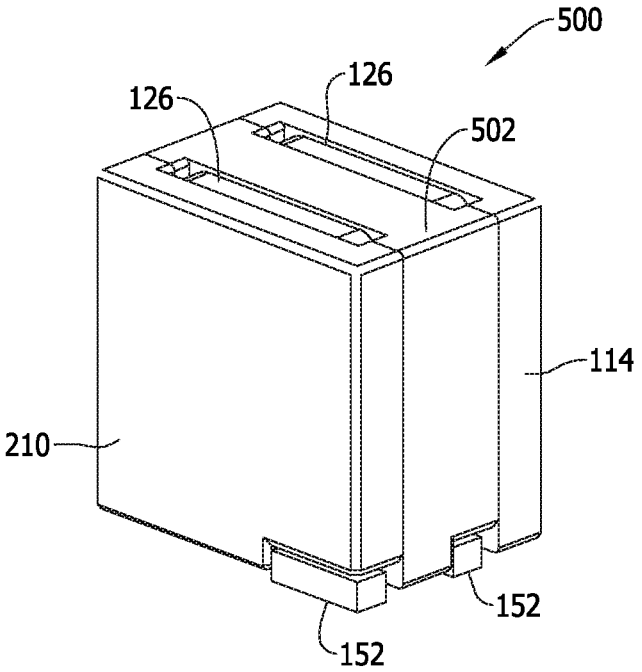
FIG. 23 is a perspective view of an improved high current power inductor including surface mount terminations for a circuit board application according to a tenth exemplary embodiment of the invention.
Figure 24:
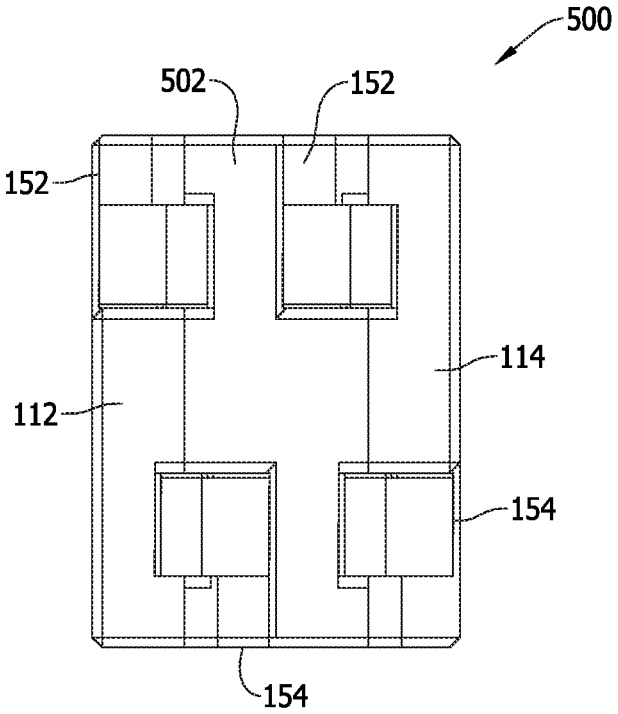
FIG. 24 is a bottom view of the power inductor shown in FIG. 23 and illustrating the surface mount terminals of the inductor coil winding.

FIGS. 23 and 24 illustrate views of an improved electromagnetic component 500 according to a tenth exemplary embodiment of the invention. FIG. 23 is a perspective view of the component 500 and FIG. 24 is a bottom view of the component 500. The component 500 may be configured as a power inductor component in contemplated embodiments. The component 500 may be used in lieu of or in addition to the previously described components on the circuit board 102.

The component 500 is an expanded version of the component 150 described above to include a second coil winding 116 and a third magnetic core piece 502 extending between the magnetic core pieces 112, 114. The magnetic core piece 502 includes two sets of vertical slots on each opposing side thereof to respectively partly receive the coplanar winding legs 122, 124 of each of the two coil windings 116. The component 500 may therefore be utilized in a two phase power application. Additional magnetic core pieces 502 and coil windings 116 may be added to scale the component to include any number n of coil windings integrated on a common core structure using the modular component core pieces and windings. Polyphase power systems may therefore be accommodated with space efficiencies on the circuit board 102. The minimal width W and the advantages of the components described earlier are still realized in the component 500, albeit having more components in the assembly.

Figure 25:
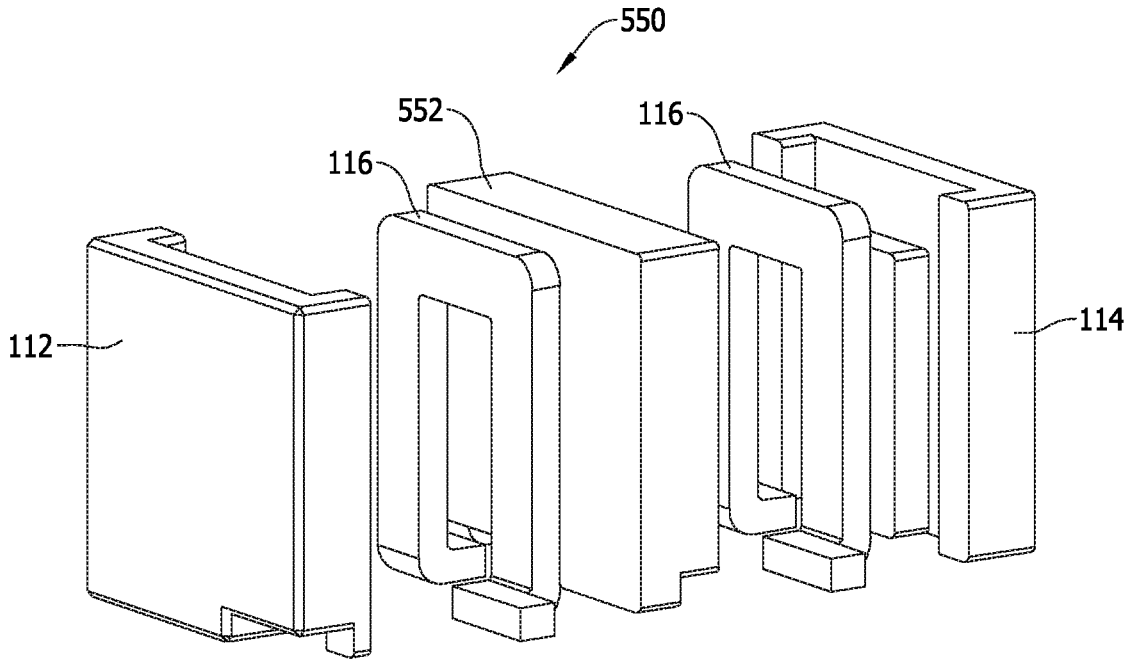
FIG. 25 is an exploded view of an improved high current power inductor including surface mount terminations for a circuit board application according to an eleventh exemplary embodiment of the invention.

FIG. 25 is an exploded view of an improved electromagnetic component 550 according to a tenth exemplary embodiment of the invention. The component 550 may be configured as a power inductor component in contemplated embodiments. The component 550 may be used in lieu of or in addition to the previously described components on the circuit board 102.

The component 550 is an alternative version of the component 500 that includes a second coil winding 116 and a third magnetic core piece 552 extending between the magnetic core pieces 112, 114. Unlike the magnetic core piece 502 in the component 500 that include vertical slots to receive the coplanar winding legs 122, 124, the magnetic core piece 552 does not include vertical slots and is therefore simpler shaped and easier to fabricate. The component 550 including the two coil windings 116 may be utilized in a two phase power application. Additional magnetic core pieces 552 and coil windings 116 may be added to scale the component to include any number n of coil windings integrated on a common core structure using the modular component core pieces and windings. Polyphase power systems may therefore be accommodated with space efficiencies on a circuit board. The minimal width W and the advantages of the components described earlier are still realized in the component 550, albeit having more components in the assembly.

Figure 26:
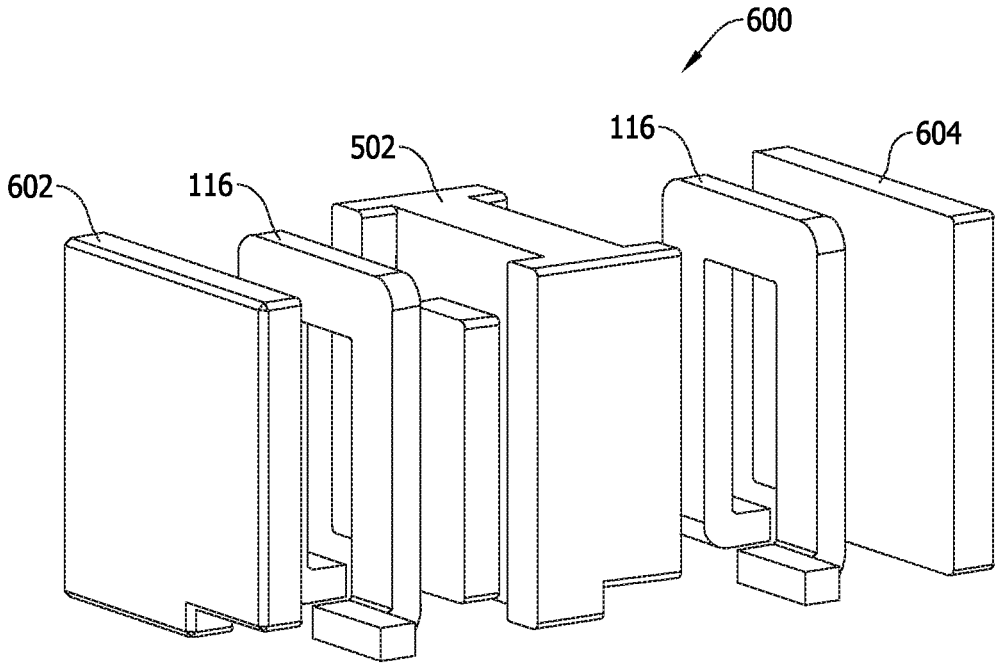
FIG. 26 is an exploded view of an improved high current power inductor including surface mount terminations for a circuit board application according to a twelfth exemplary embodiment of the invention.

FIG. 26 is an exploded view of an improved electromagnetic component 600 according to an eleventh exemplary embodiment of the invention. The component 600 may be configured as a power inductor component in contemplated embodiments. The component 600 may be used in lieu of or in addition to the previously described components on the circuit board 102.

The component 600 is an alternative version of the component 500 that includes first and second magnetic core pieces 602, 604, first and second coil windings 116 and a magnetic core piece 502 extending between the coil windings 116. Unlike the magnetic core piece 112, 114 in the components 500, 550 that include vertical slots to receive the coplanar winding legs 122, 124 of each winding 126, the magnetic core pieces 602, 604 do not include vertical slots and are therefore simpler shaped and easier to fabricate. The component 600 including the two coil windings 116 may be utilized in a two phase power application. Additional magnetic core pieces 502 and coil windings 116 may be added to scale the component to include any number n of coil windings integrated on a common core structure using the modular component core pieces and windings. Polyphase power systems may therefore be accommodated with space efficiencies on a circuit board. The minimal width W and the advantages of the components described earlier are still realized in the component 600, albeit having more components in the assembly.

Figure 27:
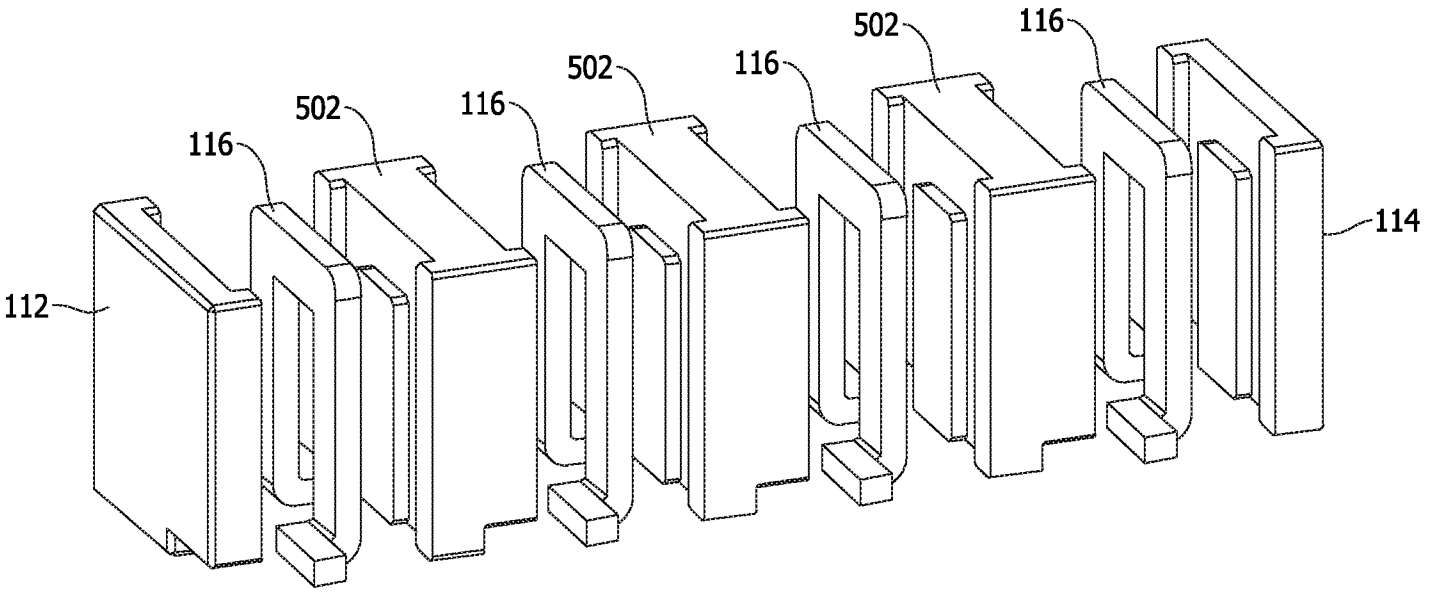
FIG. 27 is an expanded exploded view of the improved high current power inductor shown in FIG. 26.

FIG. 27 is an exploded view of an improved electromagnetic component 650 that is an expanded version of the component 500 including additional magnetic core pieces 502 and coil windings 116 to provide four coil windings 116 integrated on a common core structure including three magnetic core pieces 502 and the magnetic core pieces 112, 114. In further embodiments, more than four coil windings 116 can be provided with additional magnetic core pieces 502. The component 650 may be configured as a power inductor component in contemplated embodiments. The component 650 may be used in lieu of or in addition to the previously described components on the circuit board 102. The minimal width W and the advantages of the components described earlier are still realized in the component 600, albeit having more components in the assembly.

It is recognized that embodiments similar to those shown and described in FIGS. 23-27 that include the multiple coil windings 116 and combinations of the magnetic pieces described to receive the coil windings 116. Likewise, the coil windings 202 may likewise be utilized with combinations and adaptations of the magnetic core pieces described to provide multiple coils integrated on a common core structure to meet the needs of multi-phase power systems or to realize greater space efficiencies on the circuit board 102. The components described are adaptable and scalable in modular form to include a single preformed coil between two magnetic core pieces or n numbers of additional preformed coils and n numbers of additional magnetic core pieces to realize a component having the desired numbers of winding coils in the end result.

The benefits and advantages of the invention are now believed to have been amply illustrated in relation to the exemplary embodiments disclosed.

An embodiment of an electromagnetic component assembly for a circuit board has been disclosed. The component assembly includes a magnetic core assembled from a first magnetic core piece and a second magnetic core piece, wherein each of the first magnetic core piece and the second magnetic core piece each include a top side and a bottom side, wherein the top side is elevated from the circuit board and the bottom side is proximate the circuit board in use, and wherein the first magnetic core piece and the second magnetic core piece are arranged side-by-side. A first preformed conductive coil winding is received by at least one of the first magnetic core piece and the second magnetic core piece, wherein the first preformed conductive coil winding includes a top winding section extending to the top side of at least one of the first magnetic core piece and the second magnetic core piece. A pair of winding legs extend from opposing ends of the top winding section and defining a U-shaped winding section therewith, wherein the pair of winding legs extend coplanar to one another and are oriented perpendicular to the circuit board in use, the pair of winding legs further being located in between the first magnetic core piece and the second magnetic core piece. First and second surface mount terminals respectively extend perpendicular from the pair of winding legs opposite the top winding section, wherein the first surface mount terminal extends in a first direction and solely on the bottom side of the first magnetic core piece, and wherein the second surface mount terminal extends in a second direction solely on the bottom side of the second magnetic core piece.

Optionally, the top winding section may be a planar element extending in a coplanar relationship to the pair of winding legs. The top winding section may be centered between the first magnetic core piece and the second magnetic core piece. The first and second surface mount terminals may each extend to two side edges on the bottom side of the respective first and second magnetic core piece.

As further options, at least one of the first and second magnetic core piece may be formed with a pair of vertical slots to respectively receive the pair of winding legs. In some embodiments, both of the first and second magnetic core piece may be formed with a pair of vertical slots to respectively receive the pair of winding legs. At least one of the first and second magnetic core piece may also be formed with an upper recess to receive the top winding section. In some embodiments, both of the first and second magnetic core pieces may be formed with an upper recess to receive the top winding section. Each of the first and second magnetic core piece may be formed with only one lower recess to receive a respective one of the first and second surface mount terminals. The first surface mount terminal may extend axially on the bottom side of the first magnetic core piece for a greater distance than the second surface mount terminal extends on the bottom side of the second magnetic core piece.

The magnetic core optionally has a length dimension, a width dimension, and a height dimension, wherein the length and height dimensions are substantially greater than the width dimension. The first and second surface mount terminals may extend parallel to the width dimension. The plane of the pair of winding legs may be oriented to extend parallel to the length dimension of the magnetic core. The first and second magnetic core pieces may have a different width from one another. The top winding section may extend in a plane perpendicular to the plane of the pair of winding legs. The top winding section may overly one of the first and second magnetic core pieces but not the other.

The electromagnetic component assembly may further include a second preformed conductive coil winding and a third magnetic core piece separating the first preformed conductive coil winding from the second preformed conductive coil winding. The third magnetic core piece may include vertical slots to receive the pair of winding legs of at least one of the first and second preformed conductive coil winding. The assembly may be scalable to include n numbers of additional preformed coils and n numbers of additional core pieces.

The components may be configured as power inductors.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electromagnetic component assembly for a circuit board, the component assembly comprising:

a magnetic core assembled from a first magnetic core piece and a second magnetic core piece, wherein each of the first magnetic core piece and the second magnetic core piece each include a top side and a bottom side, wherein the top side is elevated from the circuit board and the bottom side is proximate the circuit board in use, and wherein the first magnetic core piece and the second magnetic core piece are arranged side-by-side; and a first preformed conductive coil winding received by at least one of the first magnetic core piece and the second magnetic core piece, wherein the first preformed conductive coil winding includes:

a top winding section extending to the top side of at least one of the first magnetic core piece and the second magnetic core piece;

a pair of winding legs extending from opposing ends of the top winding section and defining a U-shaped winding section therewith, wherein the pair of winding legs extend coplanar to one another and are oriented perpendicular to the circuit board in use, the pair of winding legs further being located in between the first magnetic core piece and the second magnetic core piece; and first and second surface mount terminals respectively extending perpendicular from the pair of winding legs opposite the top winding section, wherein the first surface mount terminal extends in a first direction and solely on the bottom side of the first magnetic core piece, and wherein the second surface mount terminal extends in a second direction solely on the bottom side of the second magnetic core piece.

2. The electromagnetic component assembly of claim 1, wherein the top winding section is a planar element extending in a coplanar relationship to the pair of winding legs.

3. The electromagnetic component assembly of claim 1, wherein the top winding section is centered between the first magnetic core piece and the second magnetic core piece.

4. The electromagnetic component assembly of claim 1, wherein the first and second surface mount terminals each extend to two side edges on the bottom side of the respective first and second magnetic core piece.

5. The electromagnetic component assembly of claim 1, wherein at least one of the first and second magnetic core piece is formed with a pair of vertical slots to respectively receive the pair of winding legs.

6. The electromagnetic component assembly of claim 5, wherein both of the first and second magnetic core piece are formed with a pair of vertical slots to respectively receive the pair of winding legs.

7. The electromagnetic component assembly of claim 6, wherein at least one of the first and second magnetic core piece is formed with an upper recess to receive the top winding section.

8. The electromagnetic component assembly of claim 7, wherein both of the first and second magnetic core pieces are formed with an upper recess to receive the top winding section.

9. The electromagnetic component assembly of claim 1, wherein each of the first and second magnetic core piece is formed with only one lower recess to receive a respective one of the first and second surface mount terminals.

10. The electromagnetic component assembly of claim 1, wherein the first surface mount terminal extends axially on the bottom side of the first magnetic core piece for a greater distance than the second surface mount terminal extends on the bottom side of the second magnetic core piece.

11. The electromagnetic component assembly of claim 1, wherein the magnetic core has a length dimension, a width dimension, and a height dimension, wherein the length and height dimensions are substantially greater than the width dimension.

12. The electromagnetic component assembly of claim 11, wherein the first and second surface mount terminals extend parallel to the width dimension.

13. The electromagnetic component assembly of claim 11, wherein a plane of the pair of winding legs is oriented to extend parallel to the length dimension of the magnetic core.

14. The electromagnetic component assembly of claim 11, wherein the first and second magnetic core pieces have a different width from one another.

15. The electromagnetic component assembly of claim 1, wherein the top winding section extends perpendicularly to the plane of the pair of winding legs.

16. The electromagnetic component assembly of claim 15, wherein the top winding section overlies one of the first and second magnetic core pieces but not the other.

17. The electromagnetic component assembly of claim 1, further comprising a second preformed conductive coil winding and a third magnetic core piece separating the first preformed conductive coil winding from the second preformed conductive coil winding.

18. The electromagnetic component assembly of claim 17, wherein the third magnetic core piece includes vertical slots to receive the pair of winding legs of at least one of the first and second preformed conductive coil winding.

19. The electromagnetic component assembly of claim 17, wherein the assembly is scalable to include n numbers of additional preformed coils and n numbers of additional core pieces.

20. The electromagnetic component assembly of claim 1, wherein the component is a power inductor.

* * * * *